US006383036B1

(12) United States Patent
Steinhauser et al.

(10) Patent No.: US 6,383,036 B1
(45) Date of Patent: May 7, 2002

(54) ELECTRICAL PLUG-AND-SOCKET DEVICE COMPRISING A FIXING UNIT

(75) Inventors: Uwe Steinhauser, Filderstadt; Stefan Fenger, Winnenden, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/674,981

(22) PCT Filed: Dec. 10, 1999

(86) PCT No.: PCT/DE99/03957

§ 371 Date: Apr. 13, 2001

§ 102(e) Date: Apr. 13, 2001

(87) PCT Pub. No.: WO00/54375

PCT Pub. Date: Sep. 14, 2000

(30) Foreign Application Priority Data

Mar. 10, 1999 (DE) ..... 299 043 81 U

(51) Int. Cl.[7] ..... H01R 13/514
(52) U.S. Cl. ..... 439/752; 439/357
(58) Field of Search ..... 439/489, 752, 439/350–358

(56) References Cited

U.S. PATENT DOCUMENTS 5,127,847 A * 7/1992 Kato et al. ..... 439/489
5,507,666 A * 4/1996 Yamanashi ..... 439/489
5,759,058 A * 6/1998 Childs et al. ..... 439/352
5,823,813 A * 10/1998 Dye ..... 439/358 X
6,068,507 A * 5/2000 Popa ..... 439/489
6,109,956 A * 8/2000 Kawase et al. ..... 439/489

FOREIGN PATENT DOCUMENTS

| | | |
|---|---|---|
| DE | 40 06 429 | 9/1990 |
| DE | 42 02 846 | 2/1993 |
| DE | 195 06 235 | 8/1996 |
| EP | 0 449 239 | 10/1991 |

* cited by examiner

*Primary Examiner*—Brian Sircus
*Assistant Examiner*—Son V. Nguyen
(74) *Attorney, Agent, or Firm*—Kenyon & Kenyon

(57) ABSTRACT

An electric plug-and-socket device having a fixation device and having a closed position of the plug-and-socket device that is discernable readily from the outside and is securable. The plug-and-socket device, which is composed of a first plug connector and a second plug connector which can be joined to it, is provided with a control slide mounted on the first plug connector as part of the fixation device. This control slide is convertable from an unlocked position in which it assumes a first position with respect to a mark to a locked position in which it assumes a second position with respect to the mark only when the two plug connectors have been joined completely. The closed position of the plug-and-socket device is discernable readily by the second position of the control slide with respect to the mark and is additionally securable by the control slide.

7 Claims, 4 Drawing Sheets

ELECTRICAL PLUG-AND-SOCKET DEVICE COMPRISING A FIXING UNIT

BACKGROUND INFORMATION

Field of the Invention

The present invention relates to an electric plug-and-socket device having a fixation device. In German Patent No. 42 02 846 is discussed a fixation device which detachably secures a plug-and-socket device after being joined and which can be provided with an electric plug-and-socket device composed of a plug and a mating plug connectable to it.

The fixation device is composed of a peripheral groove in a plug housing and a burr whose dimension matches this groove on a mating plug housing, so that when this housing having corresponding contacts is joined, a mechanical latching connection on the inside between the groove and the burr leads to an electric connection of the respective contacts.

In rare cases when using this fixation principle, it may occur in the case of an unfavorable tolerance that although electric contact has been made, the interior fixation device, which is not visible from the outside, is not yet properly engaged. If such an incompletely secured plug-and-socket device in a vehicle is evaluated as being in good order in electric testing, the plug-and-socket device may fail under the influence of vibrations during operation of the vehicle.

With this type of fixation device, this would endanger the operating reliability of the plug-and-socket device in an undesirable manner.

SUMMARY OF THE INVENTION

The plug-and-socket device having a fixation device according to an exemplary embodiment of the present invention has the advantage that the inadequacy described above is avoided.

Thus, the plug-and-socket device is provided with a control slide that is mounted externally and can be converted from an unlocked position in which it assumes a first position with respect to a mark into a locked position in which it assumes a second position with respect to the mark only when the plug-and-socket device has been completely joined mechanically and has been converted to a closed position.

It can thus be seen from the position of the control slide with respect to the mark whether the plug-and-socket device has been completely converted to the closed position which is additionally secured by the control slide which is converted to the unlocked position.

This yields a plug-and-socket device which is believed to be reliable in operation and can be checked easily in practice.

DETAILED DESCRIPTION

Figure 1:
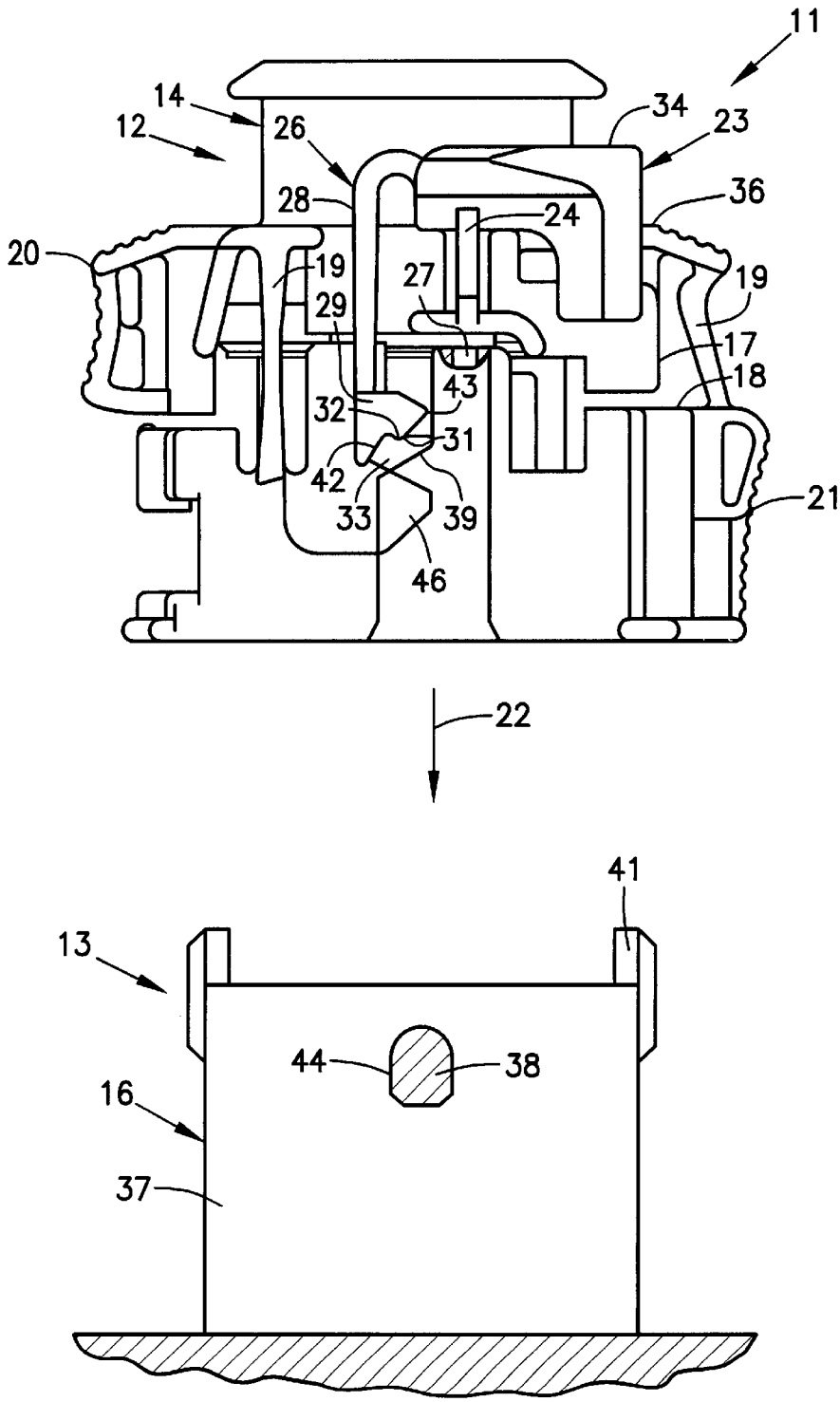
FIG. 1 shows an exemplary embodiment of the plug-and-socket device in an open position.

An electric plug-and-socket device 11 is composed of a first plug connector 12 and a second plug connector 13, which are illustrated in FIG. 1 uncoupled from one another in an open position of plug-and-socket device 11.

First plug connector 12, e.g., a cable harness plug, has a first housing 14 and second plug connector 13, e.g. a male multiplug connector on a controller, has a second housing 16. Housings 14, 16 have electric contact elements corresponding to one another in a known manner, which is not illustrated here.

First housing 14 is composed of a top part 17 and a bottom part 18, based on the diagram in FIG. 1. Both parts 17, 18 are held together by flat strip-shaped connectors 19. Due to opposing compressive forces, the two parts 17, 18 can be displaced resiliently relative to one another across an axially directed arrow 22 by a small displacement distance via a first handling face 20 on top part 17 and an opposing second handling face 21 on bottom part 18. Arrow 22 indicates a plug direction for closing plug-and-socket device 11.

A control slide 23 is mounted on top part 17, its axial displaceability being dependent on the coupling status of plug-and-socket device 11. A guide element 24 and a latching element 26 are designed on control slide 23.

Guide element 24 is embodied by an axially directed web provided with a dovetailed guide which can be connected in a form-fitting manner to a mating guide 27 on bottom part 18 and is arranged so that it is aligned axially in the case of an axial displacement of the guide element.

Latching element 26 has a latching arm 28 which is directed essentially axially in FIG. 1 and has a latching projection 29 pointing in the radial direction on its free end. Latching projection 29 rests on an oppositely directed mating latch face 32 of a stop 33 on bottom part 18 in the uncoupled state of plug-and-socket device 11 according to FIG. 1 with a latch face 31 acting radially, thus blocking the axial displaceability of control slide 23.

In the starting position described above, control slide 23 assumes an unlocked position where an end reference face 34 of control slide 23 is located in a clearly visible manner at a distance in a first position from a mark 36 which is provided on first housing 14.

Mating latch face 32 is also provided with a small bulge which also prevents latch face 31 from sliding off radially.

Second housing 16 has a collar 37 which sheaths the contact elements of second plug connector 13 and on which a radially projecting, rounded cam 38 is formed.

Figure 2:
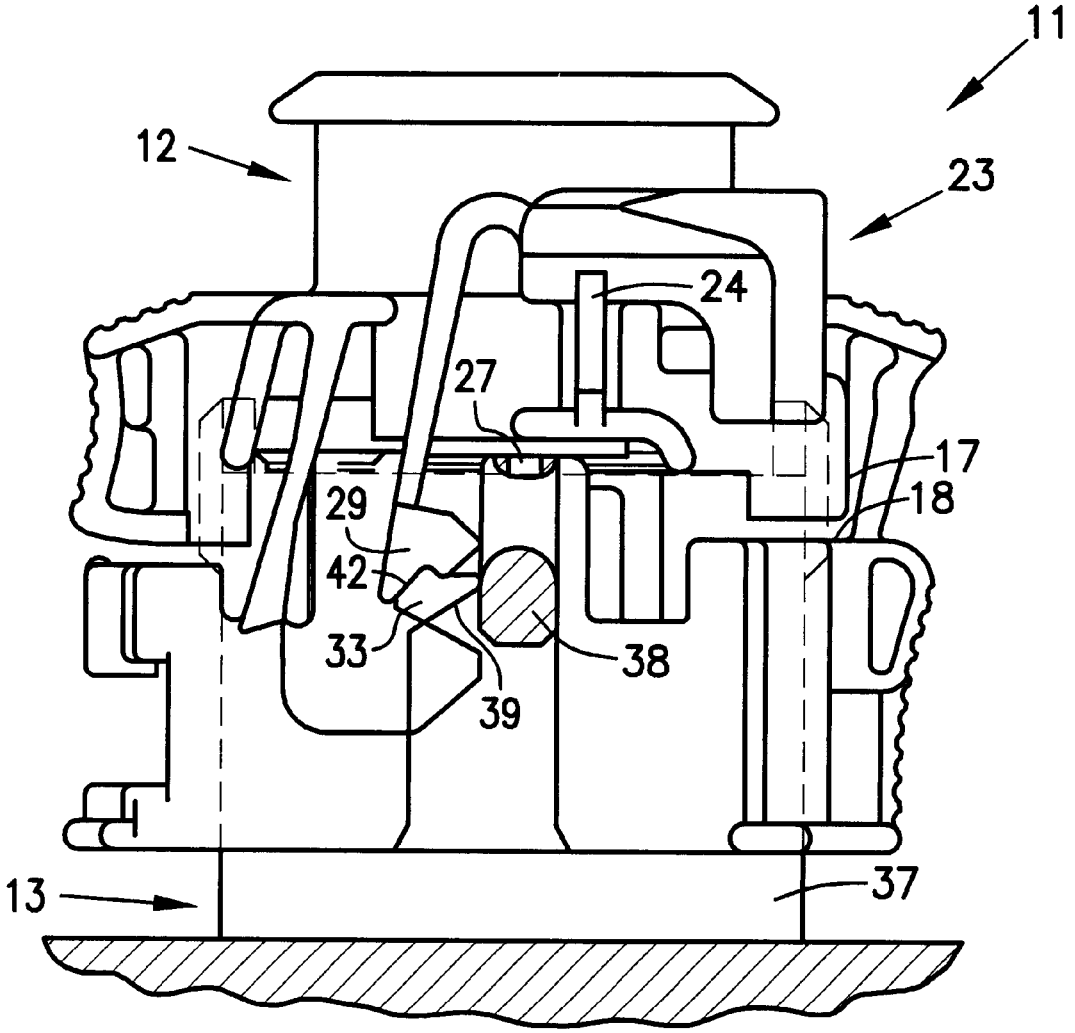
FIG. 2 shows an exemplary embodiment of the plug-and-socket device in a coupled position.

In FIG. 2, plug connector 11 is shown in a coupled position where both plug connectors 12, 13 are approximately half joined together. Following the joining of two plug connectors 12, 13 from the open position to the coupled position of plug-and-socket device 11, cam 38 runs up against an inclined stop face 39 of stop 33, and guide webs 41 visible in FIG. 1 on collar 37 projecting axially above it are engaged in a form fitting manner in guides (not shown) in top part 17.

When the joining of two plug connectors 12, 13 is continued to the coupled position, cam 38 presses stop 33 and with it bottom part 18 toward the left in FIG. 2 by a small displacement distance, because collar 37 itself cannot yield radially due to the guidance of guide webs 41 in top part 17.

With this lateral offset of two parts 17, 18 relative to one another, latching projection 29 is also entrained by an entraining face 42 of stop 33 and is offset radially by the displacement distance.

In addition, there is also a radial displacement of mating guide 27 by the displacement distance out of axial alignment with guide element 24, so that an axial displacement of control slide 23 in the coupled position of plug-and-socket device 11 is also impossible for this reason, and control slide 23 remains secured in the unlocked position.

Figure 3:
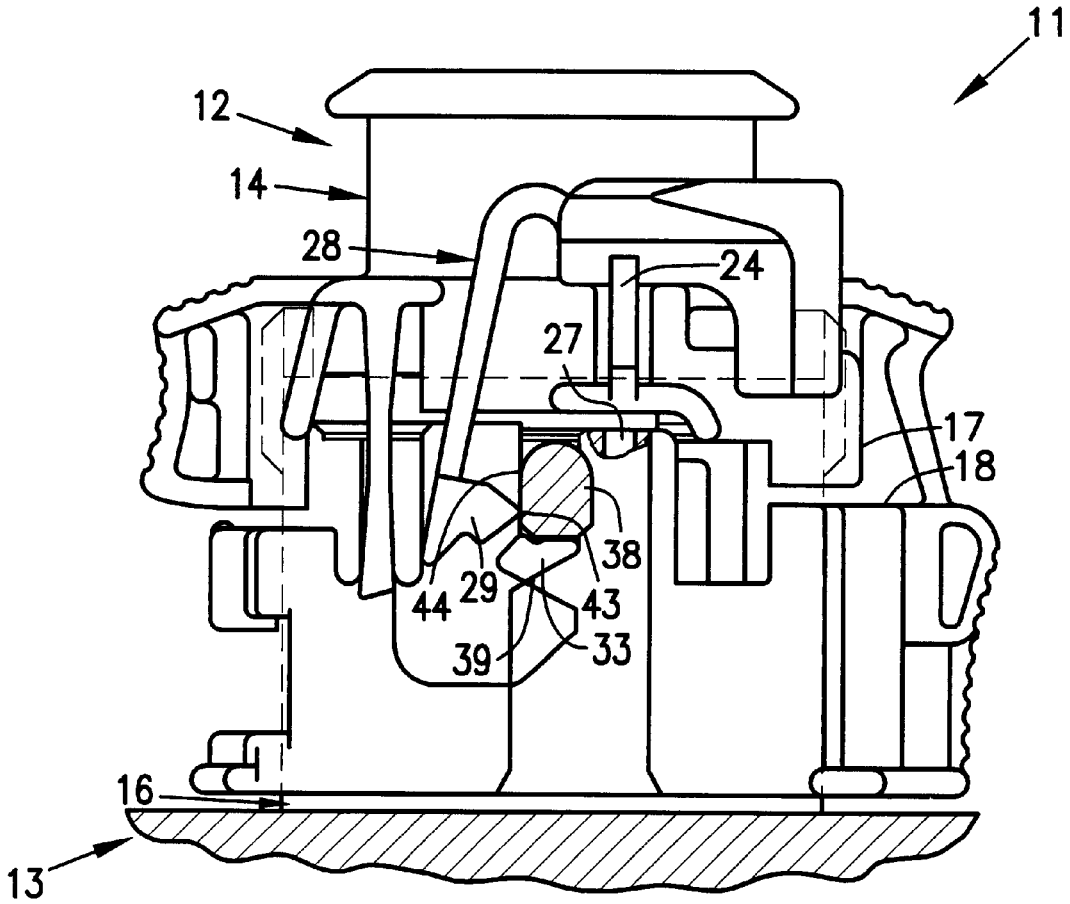
FIG. 3 shows an exemplary embodiment of the plug-and-socket device in a closed position.

FIG. 3 illustrates plug-and-socket device 11 in the closed position, where two plug connectors 12, 13 have been joined completely. Following the joining of two plug connectors 12, 13 from the coupled position to the closed position, cam 38 passes stop 33 completely in the axial direction, so that bottom part 18 which is deflected radially with respect to top part 17 by the displacement distance can snap back resiliently into its resting position according to FIG. 1, and the two plug connectors 12, 13 are thus locked together as intended on two housings 14, 16 by the engagement of stop 33 on cam 38.

When bottom part 18 snaps back into the resting position, mating guide 27 returns into axial alignment with guide element 24. However, latching projection 29 of control slide 23 remains radially offset by the displacement distance, because it is in contact at a tip 43 with a side face 44 of cam 38, and thus latching arm 28 is prevented from snapping back into the resting position according to FIG. 1.

Control slide 23 can be shifted axially by an axial force acting on reference face 34. In doing so, tip 43 slides along side face 44, and guide element 24 enters mating guide 27.

Figure 4:
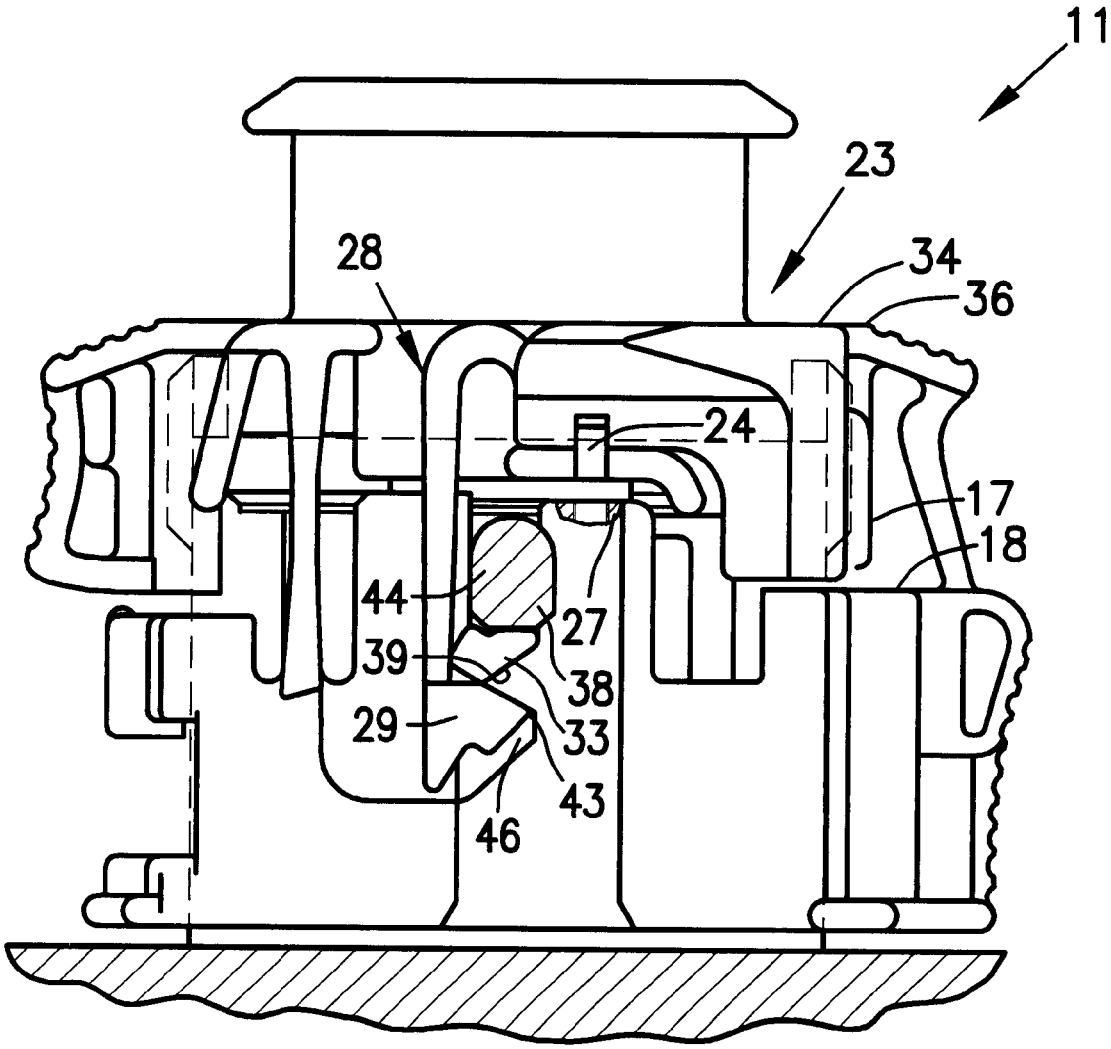
FIG. 4 shows an exemplary embodiment of the plug-and-socket device in a closed and locked position.

The axial displacement of control slide 23 is ended on reaching a locked position of control slide 23 according to FIG. 4. In this locked position, tip 43 of latching projection 29 has passed side face 44 and has snapped into a form-fitting recess 46 in bottom part 18, with latching arm 28 snapping back. In addition, reference face 34 has been lowered to the extent that it assumes a second position in which it is flush with mark 36.

Thus, the locked position of control slide 23 can be discerned readily and is an external sign that plug-and-socket device 11 is also locked in the closed position by control slide 23.

Returning plug-and-socket device 11 to the open position requires control slide 23 to be shifted back into the unlocked position which is readily discernible from the outside, because otherwise a radial deflection of bottom part 18 relative to top part 17 by the displacement distance in the locked position of control slide 23 would be blocked because of the form-fitting nature of guide element 24 in mating guide 27. However, this block must be released in order to eliminate the form-fitting connection between stop 33 and cam 38, which is necessary for an axial separation of two plug connectors 12, 13 to convert plug-and-socket device 11 to the open position.

What is claimed is:

1. An electric plug-and-socket device comprising:

a first plug connector having a first housing;

a second plug connector having a second housing, wherein the first plug connector and the second plug connector have matching contact elements and are reversibly coupled in an axial plug direction for closing the electric plug-and-socket device; and a fixation device for securing the electric plug-and-socket device in a closed position in a detachable manner, the fixation device being provided on the first housing and the second housing, and the fixation device including a control slide mountable externally on the first housing and on which at least one guide element and a latching element are provided; wherein:

an axial displacement of the control slide is blockable at least by the latching element in an open position of the electric plug-and-socket device in which the two plug connectors are uncoupled from one another, and in a coupled position of the electric plug-and-socket device in which the first plug connector and the second plug connector are partially joined;

the latching element is free floating in a closed position of the electric plug-and-socket device in which the first plug connector and the second plug connector are completely joined; and the control slide is convertable from an unlocked position in which it assumes a first position with respect to a mark on the first housing to a locked position by a displacement of the latching element into a recess, where the control slide includes a reference face, and another displacement of the guide element into a mating guide, the guide element locking the closed position of the electric plug-and-socket device and the control slide assuming a second position with respect to the mark in the locked position, where the reference face is flush with the mark when the control slide is in the second position.

2. The plug-and-socket device of claim 1, further comprising:

a stop for blocking the axial displacement of the control slide out of the unlocked position of the control slide, wherein the latching element includes a latching arm, which runs essentially axially and which is radially displaceable, and a latching projection on the latching arm that, in the open position and in the coupled position of the plug-and-socket device, rests on the first housing with a radially directed latch face on a radially directed mating latch face of the stop for blocking the axial displacement of the control slide out of the unlocked position of the control slide.

3. The plug-and-socket device of claim 2, wherein the first housing includes a top part and a bottom part, the top part and the bottom part being joined together by connectors and being resiliently displaceable relative to one another across a plug direction by a displacement distance.

4. The plug-and-socket device of claim 3, wherein:

the control slide is mountable on the top part; and the stop and the mating guide are associated with the bottom part.

5. The plug-and-socket device of claim 4, wherein the stop includes an inclined stop face for stopping a cam of the second plug connector when joining the first plug connector and the second plug connector to the coupled position of the plug-and-socket device and for deflecting the bottom part across the plug direction with respect to the top part by the displacement distance.

6. The plug-and-socket device of claim 5, wherein when the first plug connector and the second plug connector are joined to form the closed position of the electric plug-and-socket device, the stop having the mating latch face engages the cam to secure the closed position of the electric plug-and-socket device, the bottom part springs back with respect to the top part by the displacement distance, and the mating latch face is a distance away from the radially directed latch face.

7. The plug-and-socket device of claim 6, wherein in the closed position of the electric plug-and-socket device, the control slide is axially displaceable in the direction of the bottom part to the locked position of the control slide for establishing a form-fitting connection between the guide element and the mating guide for locking the closed position of the electric plug-and-socket device.

* * * * *

UNITED STATES PATENT AND TRADEMARK OFFICE

CERTIFICATE OF CORRECTION

PATENT NO. : 6,383,036 B1
DATED : May 7, 2002
INVENTOR(S) : Steinhauser et al.

It is certified that error appears in the above-identified patent and that said Letters Patent is hereby corrected as shown below:

Column 1,
Line 3, delete "BACKGROUND INFORMATION"
Line 5, change "Field of the Invention," to -- FIELD OF THE INVENTION --
Line 8, change "… device. In German …" to -- … device.
BACKGROUND INFORMATION
In German … --

Signed and Sealed this

Eighteenth Day of February, 2003

JAMES E. ROGAN
*Director of the United States Patent and Trademark Office*